United States Patent [19]

Kilmer

[11] Patent Number: 4,633,921

[45] Date of Patent: Jan. 6, 1987

[54] ADJUSTABLE SUPPORT BRACKET FOR CONDUCTOR WRAPPING TOOL ATTACHMENT

[75] Inventor: Paul R. Kilmer, Leroy, Mich.

[73] Assignee: Cooper Industries, Inc., Houston, Tex.

[21] Appl. No.: 743,855

[22] Filed: Jun. 12, 1985

[51] Int. Cl.[4] ..... B21F 15/00

[52] U.S. Cl. ..... 140/124; 7/107; 242/7.17

[58] Field of Search ..... 7/107, 108; 140/122, 140/124; 242/7.17, 7.18; 248/359 R, 359 F, 359 G, 360

[56] References Cited

U.S. PATENT DOCUMENTS

| | | | |
|---|---|---|---|
| 3,179,130 | 4/1965 | Silins et al. | 242/7.18 |
| 3,327,374 | 6/1967 | Lulick et al. | 242/7.17 |
| 3,409,230 | 11/1968 | Eelkeme | 248/359 F |
| 3,554,243 | 1/1971 | DeRose et al. | 140/124 |
| 3,618,641 | 11/1971 | Hannify | 140/124 |
| 3,619,829 | 11/1971 | Finn et al. | 7/107 |
| 3,716,080 | 2/1973 | Scaddan et al. | 242/7.17 |
| 4,074,732 | 2/1978 | Wilkens | 7/107 |
| 4,382,456 | 5/1983 | Rapp | 7/107 |

FOREIGN PATENT DOCUMENTS

| | | | |
|---|---|---|---|
| 694583 | 7/1953 | United Kingdom | 7/107 |

*Primary Examiner*—Lowell A. Larson

*Attorney, Agent, or Firm*—Michael E. Martin; Eddie E. Scott; Alan R. Thiele

[57] ABSTRACT

A portable hand held pistol grip type conductor wrapping tool has a tool body with a forward projecting nose portion having a transverse face and a polygonal boss formed thereon for receiving a generally disk shaped mounting bracket for a conductor insulation stripping device. The mounting bracket has a polygonal recess complementary to and adapted to be supported on the boss in one of a plurality of circumferentially spaced working positions with respect to the longitudinal axis of the tool. A threaded nose projection extends forwardly from the boss for receiving a not and resilient "o" ring type gasket for retaining the mounting bracket rigidly secured on the tool body in its selected working position.

8 Claims, 4 Drawing Figures

ADJUSTABLE SUPPORT BRACKET FOR CONDUCTOR WRAPPING TOOL ATTACHMENT

BACKGROUND OF THE INVENTION

1. Field of the Invention

The present invention pertains to a portable hand held conductor wrapping tool having an adjustable support bracket which may be locked in a selected one of alternate positions for supporting an attachment to the tool such as an insulation stripping device.

2. Background

In the use of hand held conductor wrapping tools in operations wherein unstripped conductor wires are being wrapped it is usually required to attach an insulation stripping device to the tool body. This device is normally mounted generally above the tool main body section or barrel and preferably should be adapted for mounting in a selected one of various positions relative to the tool handle to accommodate the operator's range of movement when stripping insulation from the ends of insulated conductors prior to performing the wrapping or coiling operations.

Although various devices have been developed for supporting wire insulation stripping attachments to portable hand held conductor wrapping tools these devices normally provide for only one fixed position of the attachment relative to the tool body or are mounted with friction lock type devices wherein the position of the wire stripping attachment may be inadvertently changed if the tool is dropped or handled roughly. In this regard it is desirable that an uncomplicated mounting bracket be provided which is adapted to be selectively positioned in one or more working positions for supporting a tool attachment such as a wire strapping device without the chance of the attachment being inadvertently moved from its selected working position. To this end the present invention has been developed with a view to providing a mechanically uncomplicated, economically manufacturable support bracket arrangement for a conductor wrapping tool which may be disposed in a selected one of several working positions and positively locked in the selected position to prevent inadvertent slippage or re-positioning of the tool attachment.

SUMMARY OF THE INVENTION

The present invention provides improved means for mounting a wire stripping attachment or the like to a portable conductor wrapping tool in a selected one of plural working positions of the attachment without slippage or unwanted movement of the mounting means.

In accordance with one aspect of the present invention there is provided a mounting bracket particularly adapted for use in conjunction with a hand held conductor wrapping tool wherein the nose of the tool barrel or body is provided with a boss and the mounting bracket is provided with a complementary recess for supporting the mounting bracket on the boss in a selected one of plural working positions of the mounting bracket.

In accordance with another aspect of the present invention there is provided a mounting bracket arrangement for a portable conductor wrapping tool which may be easily moved from one working position to another and held in the selected working position in positively locked engagement with the tool body. The mounting bracket is secured in a selected working position by a nut which is threaded over a nose portion or the tool body and may be positioned to prevent movement of the mounting bracket relative to the support boss and may be partially unthreaded to permit movement of the mounting bracket off of the boss and to a selected alternate working position of the mounting bracket.

More particularly, the present invention provides a mounting bracket for an attachment to a portable conductor wrapping tool characterized by a formed metal or plastic member having a polygonal recess formed therein and registrable with a complementary polygonal shaped boss formed on the tool body. The mounting bracket also includes a pair of opposed clamping jaws for receiving a support slide of an attachment device for the tool such as a wire insulation stripper or the like. The mounting bracket is secured in a selected working position by a resilient gasket interposed between the nut and the mounting bracket for assistance in holding the nut in its tightened condition and to permit relatively easy hand threading and unthreading of the nut so that the working position of the mounting bracket may be changed at will.

The abovementioned features and advantages of the present invention as well as other superior aspects thereof will become apparent to those skilled in the art upon reading the detailed description which follows in conjunction with the drawing.

DESCRIPTION OF THE PREFERRED EMBODIMENT

Figure 1:
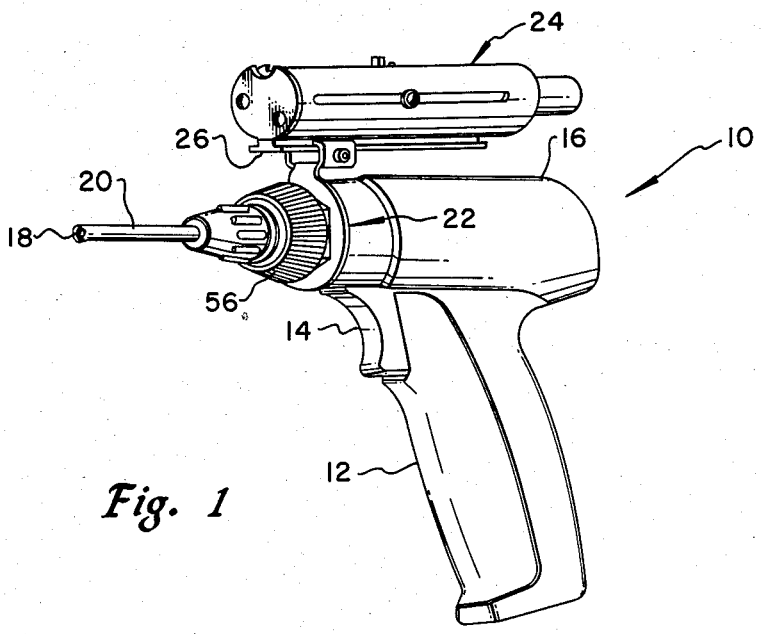
FIG. 1 is a perspective view of a portable pistol grip type conductor wrapping tool including the improved mounting bracket arrangement of the present invention.

In the description which follows like parts are marked with the same reference numerals, respectively. The drawing figures are not necessarily to scale and certain features of the invention may be shown exaggerated in scale in the interest of clarity.

Referring to FIG. 1, there is illustrated a portable hand held pistol grip type conductor wrapping tool, generally designated by the numeral 10. The tool 10 is of a type which may be powered by an electric or fluid operated motor and manufactured under the trademark WIRE WRAP by the assignee of the present invention. The tool 10 includes a pistol hand grip 12, a motor actuating trigger 14 and a barrel or body 16. A rotary conductor wrapping bit 18 is supported on the body 16 and is drivenly connected to a motor, not shown, and is typically disposed with an elongated tubular sleeve 20.

The tool body 16 is particularly adapted to support an improved mounting bracket, generally designated by the numeral 22, for mounting an attachment on the tool 10 such as a flexible conductor insulation stripping device, generally designated by the numeral 24. The device 24 includes an elongated somewhat inverted T-shaped mounting slide 26 for connection to the mounting bracket 22 in a manner to be described in further detail herein. The detailed construction of the conductor insulation stripping device 24 is not believed to be necessary to enable one skilled in the art to practice the present invention. Suffice it to say that the position of the device 24 with respect to the body 16 and the hand grip 12 is of some importance to the tool operator so that more efficient handling of conductor wire may be obtained in the operation of the tool. For example, in regard to whether or not the operator is left or right handed the operator may prefer to position the insulation stripping device 24 in a generally vertically upright position relative to the tool body, as illustrated in FIG. 1, or in a selected one of two or more alternate working positions as indicated by the dashed lines in FIG. 4. Since the tool 10 is subject to repeated handling wherein the tool is layed on a work bench and then picked up for use the device 24 may be subject to movement relative to a selected working position, particularly with the use of prior art type friction locking mounting brackets. However, with the arrangement of the mounting bracket 22 in conjunction with the tool 10 the mounting bracket is positively locked in a selected working position as will be appreciated from the description which follows herein.

Figure 2:
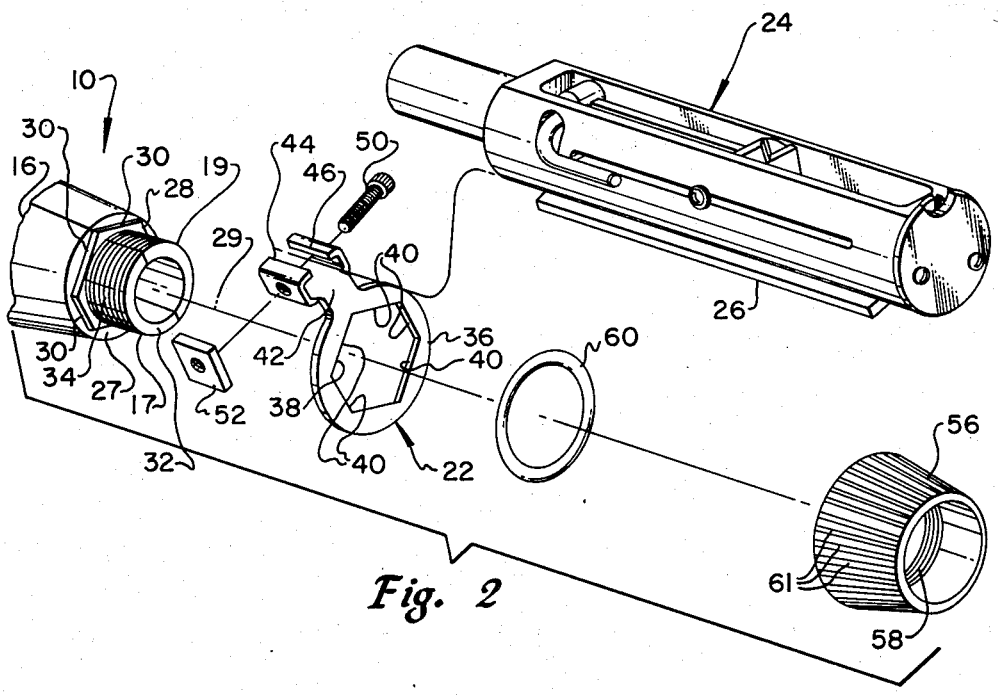
FIG. 2 is an exploded perspective view of the mounting bracket and the associated parts of the tool.
Figure 4:
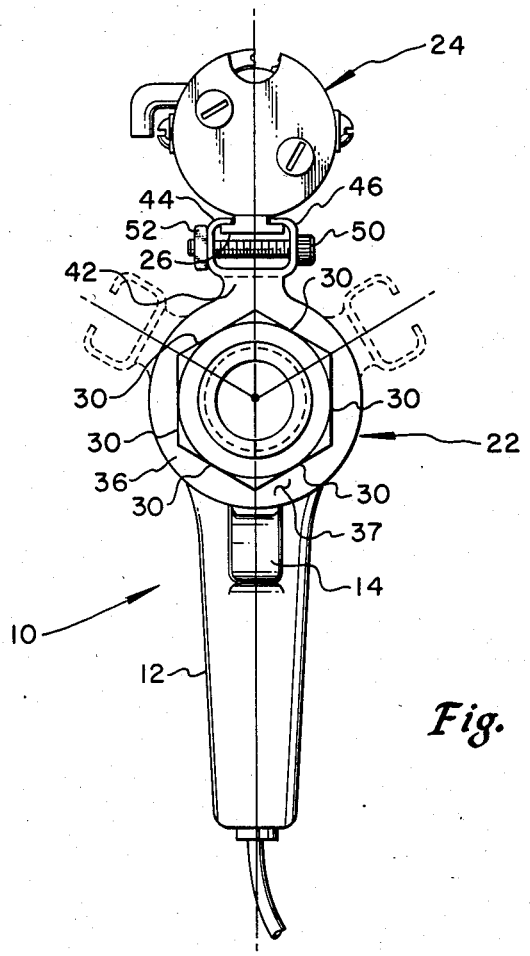
FIG. 4 is a front elevation of the tool showing various working positions of the mounting bracket.

Referring now to FIG. 2 the forward end of the tool body 16 includes a substantially transverse surface or end face 27 from which a polygonal shaped boss 28 projects axially with respect to a longitudinal central axis 29 of the tool body 16. The boss 28 is formed to have a generally hexagonal shape with six peripheral flat surfaces 30 as illustrated in FIGS. 2 and 4. However, the exact shape of the polygon may be modified to be, for example, a pentagon or octagon or other shape which may provide for plural selected working positions of the device 24 as will be appreciated from the further description herein. The body 16 further includes a generally cylindrical axially extending nose portion 32 which is provided with external threads 34 formed thereon. The body 16 may be formed from molded plastic or metal into opposed sections 17 and 19 as indicated by the parting line illustrated in FIG. 2 although this is not critical to the construction of the portion of the body illustrated.

The mounting bracket 22 comprises a stamped or otherwise formed metal or plastic member having a generally cylindrical disk portion 36 in which a polygonal recess 38 is formed which is complementary to the boss 28 and is provided with a plurality of flat surfaces 40 registrable with the respective surfaces 30 on the boss 28 to lock the bracket 22 in a selected working position when it is disposed on the boss. The bracket 22 includes a radially projecting tang portion 42 integral with the disk 36 which includes a portion 43, FIG. 3 also, bent at substantially right angles with respect with the plane of the disk portion 36 and having opposed channel shaped support jaws 44 and 46 which are dimension to receive opposed flanges of the slide 26 in supportive relationship thereto. The jaws 44 and 46 may be elastically drawn together to clamp the slide 26 to the mounting bracket 22 by a conventional threaded bolt 50 and nut 52 extending through bolt receiving holes in each one of the jaws 44 and 46.

Figure 3:
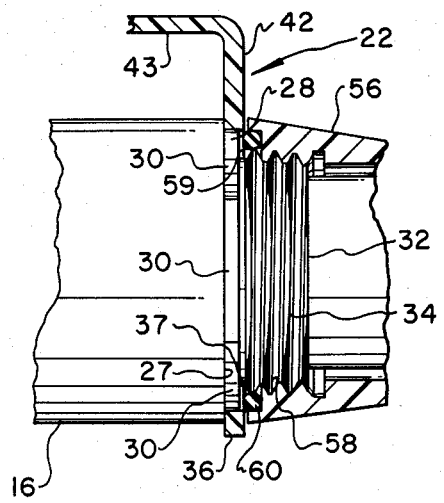
FIG. 3 is a detail longitudinal section view showing the mounting bracket in a selected working position.

The mounting bracket 22 is retained on and in registration with the boss 28 by a generally frusto-conical shaped nut 56 which includes internal threads 58 cooperable with the threads 34 on the nose portion 32. As shown in FIG. 3, the nut 56 may be provided with a counter bore 59 for receiving a resilient gasket member in the form of a conventional "o" ring 60 made of a suitable elastomeric material and engageable with the surface 37 of the disk 36 of the mounting bracket and serving somewhat the function of a lock washer for retaining the nut in a selected tight position holding the mounting bracket 22 in its selected working position. As shown in FIG. 3 the thickness of the disk portion 36 of the mounting bracket 22 is preferably slightly greater than the thickness of the polygonal boss 28 whereby the resilient "o" ring 60 forcibly engages the surface 37 upon tightening of the nut 56 to positively secure the mounting bracket in its selected working position clamped against the face 27.

When it is desired to change the working position of the insulation stripping device 24 the nut 56 is partially unthreaded from the boss 32 a sufficient distance such that the mounting bracket 22 may be moved axially off of the boss 28 and rotated to an alternate working position such as shown by the dashed alternate position lines in FIG. 4. The nut 56 is then re-tightened to forcibly engage the "o" ring 60 with the surface 37 to clamp the mounting bracket 22 between the nut and the face 26. The nut 56 is preferably provided with knurling or somewhat longitudinally extending ridges 61, FIG. 2, to facilitate manual tightening and loosening of the nut without requiring a wrench or similar tool.

Those skilled in the art will appreciate from the foregoing description the unique aspects of the present invention including the relatively uncomplicated and economically manufacturable arrangement of a mounting bracket and tool body or housing cooperable with the mounting bracket to provide a superior positively lockable support for an attachment such as a conductor insulation stripping device and the like. The various elements described herein may be manufactured from conventional engineering materials. Although a preferred embodiment of the invention has been described in detail those skillled in the art will recognize that various substitutions and modifications may be made to the specific embodiment described without departing from the scope of spirit of the invention as recited in the appended claims.

What I claim is:

1. In a portable hand held conductor wrapping tool having a tool body for supporting a rotatable conductor wrapping bit, a polygonal shaped boss formed on said body and projecting from a generally transverse surface on said body, a mounting bracket for supporting an attachment device on said body including a polygonal recess having a shape complementary to said polygonal shaped boss and adapted to be supported on said boss in a selected one of plural working positions of said mounting bracket; and means on said body for releasably securing said mounting bracket in said selected one of said working positions.

2. The tool set forth in claim 1 wherein:

said body includes a projection extending from said boss and having threads formed thereon, and said means for securing said bracket comprises a nut threadedly disposed on said projection and adapted to retain said bracket on said boss.

3. The tool set forth in claim 2 including:

resilient gasket means interposed between said nut and said mounting bracket for retaining said nut in a tightened condition and forcibly engaged with said mounting bracket to retain said mounting bracket secured against said transverse surface.

4. The tool set forth in claim 2 wherein:

said mounting bracket comprises a generally flat disk member having a radially projecting bracket portion which is configured to support said attachment in a selected working position adjacent to said body on a side of said body generally opposite a handle for said tool.

5. In a portable hand held conductor wrapping tool, a tool body including a barrel portion and a depending hand grip portion, said barrel portion including a generally transverse surface and a polygonal boss projecting from said surface, said barrel portion further including a generally cylindrical projection extending axially from of said boss, said projection including external threads formed thereon;

a mounting bracket for supporting a conductor insulation stripping attachment on said tool, said mounting bracket comprising a generally circular flat disk member having a polygonal recess formed therein complementary to said boss and adapted to be disposed on said boss in a predetermined position relative to said barrel; and a nut member threadedly engageable with said projection and adapted to securre said mounting bracket on said body in a selected working position of said attachment relative to said handle.

6. The tool set forth in claim 5 including:

a resilient gasket member configured to fit over said projection and interposed between said nut and said mounting bracket for retaining said mounting bracket secured against said transverse surface and to resist unwanted loosening of said nut.

7. The tool set forth in claim 5 wherein:

said mounting bracket includes a generally radially projecting portion including opposed elastically deflectable jaw members forming a channel for receiving a support slide of said attachment, and fastener means engageable with said jaw members for elastically deflecting said jaw members to move toward each other to secure said attachment to said mounting bracket.

8. In a portable hand held conductor wrapping tool, a tool body including a barrel portion and a depending hand grip portion, said barrel portion including a forwardly disposed generally transverse surface and a polygonal boss projecting from said surface, said barrel portion further including a generally cylindrical projection extending axially from said boss, said projection including external threads formed thereon;

a mounting bracket for supporting a conductor insulation stripping attachment on said tool, said mounting bracket comprising a generally flat disk portion having a polygonal recess formed therein complementary to said boss and adapted to be disposed on said boss in a predetermined position relative to said barrel;

a nut member threadedly engageable with said projection and adapted to secudre said mounting bracket on said body in a selected working position of said attachment relative to said handle; and a resilient gasket member configured to fit over said projection and interposed between said nut and said mounting bracket for retaining said mounting bracket secured against said transverse surface and to resist unwanted loosening of said nut.

* * * * *